US006479223B2

(12) United States Patent
Fyson et al.

(10) Patent No.: US 6,479,223 B2
(45) Date of Patent: Nov. 12, 2002

(54) METHOD OF PRODUCING A PHOTOGRAPHIC IMAGE

(75) Inventors: John R. Fyson, London; Gareth B. Evans, Hollybush Close Potton End; Peter Hewitson, Harrow, all of (GB); Jon A. Kapecki, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/853,152

(22) Filed: May 10, 2001

(65) Prior Publication Data

US 2002/0015922 A1 Feb. 7, 2002

(30) Foreign Application Priority Data

Jun. 28, 2000 (GB) ..... 0015894

(51) Int. Cl.[7] ..... G03C 5/18
(52) U.S. Cl. ..... 430/404; 430/373; 430/413
(58) Field of Search ..... 430/404, 373, 430/413

(56) References Cited

U.S. PATENT DOCUMENTS

| | | | | |
|---|---|---|---|---|
| 3,869,288 | A | 3/1975 | Godowsky | 430/383 |
| 4,469,780 | A | 9/1984 | Hirai et al. | 430/373 |
| 5,121,131 | A | 6/1992 | Bouldin et al. | 346/1.1 |
| 5,200,302 | A | 4/1993 | Iwano | 430/376 |
| 5,246,822 | A | 9/1993 | Evans et al. | 430/429 |
| 5,441,843 | A | 8/1995 | Hara et al. | 430/138 |
| 5,477,301 | A | 12/1995 | Earle et al. | 354/325 |
| 5,701,541 | A | 12/1997 | Ueda et al. | 396/569 |

FOREIGN PATENT DOCUMENTS

| | | |
|---|---|---|
| EP | 0 758 762 a1 | 2/1997 |
| WO | WO 00/38010 | 6/2000 |

OTHER PUBLICATIONS

Research Disclosure, Sep. 1997, p. 638.

*Primary Examiner*—Hoa Van Le

(57) ABSTRACT

A method of producing a photographic image in an imagewise exposed photographic material comprising one or more silver halide emulsion layers comprises applying to the material in an imagewise manner a developer solution containing a silver halide developing agent wherein the amount of solution applied depends on the image density to be produced, removing unreacted developing agent from the material or inactivating unreacted developing agent in the material by means other than immersion of the material in a liquid in a tank.

13 Claims, No Drawings

METHOD OF PRODUCING A PHOTOGRAPHIC IMAGE

FIELD OF THE INVENTION

The invention relates to a method of producing a photographic image. More particularly, the invention involves the photographic processing of silver halide materials. It applies particularly to processes which do not include washing stages which remove materials from the imaging layers. It is particularly useful for chromogenic colour development where the developer must not be allowed to remain in the image.

BACKGROUND OF THE INVENTION

Processing of photographic materials in automatic processing equipment is normally carried out using tanks of solution through which the processed material is passed. The solutions are modified as they carry out the chemical processes. The effects of this modification are compensated for by replenishment of the tanks with replenisher solutions which add chemicals that have been used during processing. Care has to be taken to replenish tank solutions accurately so that the chemical concentrations are maintained at a constant level so that consistent performance can be ensured.

Solution is lost from the tanks when the processed material leaves the tank. Also, replenisher solutions are added to the tanks in larger quantities than are removed with the processed material thus producing liquid effluent. The solution removed from the tank by over-flow and by being carried out by the processed material allows the removal of chemicals introduced by the chemical processes occurring during processing.

Single-use processing systems involving the use of small volumes of solution have been described ( Research Disclosure September 1997 p638 ). These can involve the application of solutions to the surface of materials in a way which results in a uniform amount of solution being applied. The uniform application of developer to the surface of colour negative paper using ink-jet methods has been described in EP A 94201050.5. U.S. Pat. No. 3,869,288 describes the separate application of developer solution components by spraying droplets. U.S. Pat. No. No. 5,200,302 describes a method of processing involving coating developer to produce a film of processing solution of thickness "at most 20x" that of the dry gel thickness. Uniform application results in low density areas being treated with the same chemical amounts as maximum density areas. This results in inefficient chemical use and possibly in the production of higher than required density in minimum density areas.

U.S. Pat. No. 5,121,131 describes the use of an ink-jet writer to lay down a solution of bleach in an image-wise manner on a material with a uniform, silver-containing layer to produce an image in silver after the bleaching action of the solution has taken effect.

The use of the image information to control the amount of solution applied so that it is applied in an image-wise manner has also been described in U.S. Pat. No. 5,701,541 for high silver papers. Processing involves bleaching and fixing to remove silver and silver halide followed by washing to remove all the soluble chemicals left in the coating including developing agent from the developer solution and the dissolved silver halide.

Removal of any material including developer, which will cause the image to be modified on keeping is necessary and a suitable treatment is therefore required. Removal of chemicals is usually performed by a washing stage involving the use of multiple tanks containing water or stabilising solution. These are often replenished by clean water or solutions added to the last of the sequence of tanks with overflow from the last tank replenishing the previous tank and so on until overflow emerges from the first wash/stabiliser tank. In this way, effluent is reduced but the effluent from the wash stage usually forms the majority of the liquid effluent from the process.

Low silver materials have been described which use small fractions of the amount of silver needed to provide the oxidation of developer resulting from development of the silver halide crystals when that oxidised developer is used to provide the image dye in sufficient amount for high image densities via reaction with colour-forming couplers. These low silver materials are processed in the presence of oxidising agents such as hydrogen peroxide in development amplification processes commonly referred to as Redox Amplification or RX processes. In such processes the developed silver image is used to catalyse in an image-wise manner, the production of oxidised developer and hence image dye. Such materials are appropriate for print production.

These were described in combination with the ink-jet application of developer in EP A 94201050.5. The amounts of silver coated in papers processed with RX solutions can be so low that silver can be left in the images without serious loss of quality.

The amounts of silver can also be sufficiently low to allow the retention of undissolved silver halide though it may be necessary to take steps to prevent the production of photolytic silver as described in U.S. Pat. No. 5,246,822 and U.S. Pat. No. 5,441,853.

U.S. Pat. No. 4,469,780 describes image production without washing by developing silver halide material, intensifying and treating with dilute acid-to-neutral buffer solution. Intensification with hydrogen peroxide or other oxidants is used to produce the image and no bleach or fix stages are present to remove silver or silver halide. The minimum image densities after processing are used as the criteria for the effectiveness of the post-development stages.

Colour developer can be removed by chemical treatment as described in a co-pending simultaneously filed patent application by the present applicant or by lamination with a cover sheet containing carbon as described in PCT GB99/04319. In addition, silver or silver halide can be removed by processes enabled by laminating the imaging material with a cover sheet.

It is very desirable to provide as simple and rapid a process as possible and one which requires a simple processing machine with minimal maintenance and which produces little or no effluent. Single-use processing can be used to avoid replenishment but uniform application of processing solutions results in wastage of chemicals because high levels of developer solution are applied whether image density is required or not. The higher than necessary levels of developer provide not only greater difficulty removing the developer but the excess developer produces higher than desired densities in low density image areas.

Normally, removal of unused developer by washing stages is performed and is effective but this produces liquid effluent. The other methods of extraction or destruction of developer are more limited in capacity. It is desirable to minimise the amount of material used to perform the function of extraction or destruction. When developer is applied uniformly, the amounts needed to be removed from the areas of minimum density (Dmin areas) are high. In particular, if methods such as lamination with carbon or the application of chemical treatments are used, the difficulty of removal is greatest where the largest amounts of developer exist. Further, the areas where this occurs are precisely those areas where the problems caused by any density increase are of greatest impact, namely in Dmin areas.

The use of RX processing can allow the retention of silver and silver halide in the image if coated silver levels are sufficiently low. This greatly simplifies the process cycle. However, the avoidance of stages, after development, used for the purposes of silver and silver halide removal, eliminates the opportunity for removal of developer from the coating during these stages, in particular from the low density areas. The problem of removal of developer components from Dmin areas is therefore more serious when these silver-removal stages are eliminated.

The problem to be solved therefore is to provide a process cycle involving a development stage and a subsequent treatment which produces much less liquid effluent than a multi-tank counter-current wash/stabiliser stage. Preferably, no effluent is produced whilst ensuring that the image is substantially as stable as it would be with a washing stage which produces liquid effluent, typically 200 mls/m$^2$. In particular, this problem should be solved using the minimum amounts of material used for extracting or destroying the developer components which, if left in the image, potentially destabilise the image over time.

SUMMARY OF THE INVENTION

The invention provides a method of producing a photographic image in an imagewise exposed photographic material comprising one or more silver halide emulsion layers which method comprises applying to the material in an imagewise manner a developer solution containing a silver halide developing agent wherein the amount of solution applied depends on the image density to be produced, removing unreacted developing agent from the material or inactivating unreacted developing agent in the material by means other than immersion of the material in a liquid in a tank.

DETAILED DESCRIPTION OF THE INVENTION

This invention provides a method for processing photographic material by providing a development stage in which developer is applied to the surface of the processed material in an imagewise manner and developer components harmful to the image over long-term keeping are removed or inactivated without extraction into a volume of solution in a tank e.g. without a wash tank. Unreacted developing agent may be inactivated by chemically converting the developing agent into a form in which it will no longer cause image modification e.g. by degradation. Preferably, the development stage is carried out in a way which produces substantially no liquid effluent from the process or in a way which does not require any treatment or re-use of any effluent which is produced. Unreacted developer components may be extracted or destroyed using either lamination with a separate coated material or by applying chemicals in a coating or spraying process which does not produce liquid effluent.

The photographic material used in the method of the invention may be any black and white or colour silver halide material. In a preferred embodiment, the material is a colour silver halide material e.g. a colour print or film material. In colour photographic materials, dye images can be formed by reaction of oxidised developer with image dye forming couplers. A preferred class of developing agents for chromogenic colour development is the the paraphenylene diamine class of developer agents.

A preferred form of photographic processing is redox amplification also known as development amplification. An advantage of redox amplification is that a low-silver material can be used. Low silver materials typically contain less than 400 mg/m$^2$, preferably less than 200 mg/m$^2$ silver.

With redox amplification, a bleach step may be carried out if required using solution application methods producing no effluent. Preferably, for environmental reasons, the bleaching stage uses an iron-free bleaching agent such as persulphate or peroxide. Alternatively, a process not involving a bleach step may be necessary or possible.

As a further means of simplifying the process, the fixing of the unreacted silver halide or bleached silver and its removal in liquid effluent may be avoided.

During the process cycle the photographic material can be heated to accelerate the process and remove liquid components from the processed material.

A developer solution containing a silver halide developing agent is applied to the material in an imagewise manner wherein the amount of solution applied depends on the image density to be produced.

The solution may be applied by known techniques e.g. the use of an inkjet printing head or similar device.

By adjusting the amount of processing solution in accordance with an image signal recorded on a light-sensitive material, the inkjet printing head can stop feeding the processing solution on a portion of the image not requiring development.

The image signal may either be obtained from a real image e.g. an image on a film or reflection print material by measurement of the optical density of the image by conventional reading means such as an image scanner, or it can be obtained from a digital image such as could be contained in a stored computer file such as a Kodak PhotoCD™ image or a JPEG image. The image signal thus obtained can be used, with a knowledge of the characteristics of the photographic light sensitive material to calculate the amount of image density required in any particular area of the material in order to form the desired image.

By adjusting the amount of processing solution applied to any part of the surface of the photographic material in accordance with the image density required, the application apparatus can apply lower amounts of solution where low image densities are to be produced. If a modified inkjet printer is used, the solution is applied as fine droplets. The printing heads must be capable of reliably applying the chemically corrosive solutions used for photographic processing.

In one preferred embodiment, the removal of the unreacted developer is achieved by releasably laminating the material with a receiver sheet containing an adsorbent for the developing agent in oxidised and unoxidised form, and, after a period of time sufficient for adsorption of the developing agent in the receiver sheet, separating the photographic material and the receiver sheet.

The receiver sheet may comprise a layer of the adsorbent suspended in a suitable binder coated on a support. Suitable supports include those used for photographic materials e.g.

polymer such as polyester, and paper. Suitable binders include hydrophilic colloids and other binders used in the preparation of photographic emulsion layers. A more detailed description of suitable binders may be found in *Research Disclosure,* September 1994, No. 365, Section IIA. A preferred binder is gelatin.

The adsorbent used in the invention may be chosen from any of the known adsorbents of organic compounds. A particularly preferred adsorbent is carbon e.g. activated carbon, especially activated charcoal. Alternative adsorbents include a range of polymeric materials, for example, the polymers obtained by condensation, such as polyesters, polyamides, polyurethanes, polyethers, epoxy resins, amino resins, phenol-aldehyde resins and acrylic polymers, and polymers derived from ethylenically unsatured monomers such as polyolefins, polystyrene, polyvinyl chloride, and polyvinyl acetate.

For dispersion in a binder, the adsorbents are preferably in particulate form. It is also preferred that the adsorbents are porous.

Particular examples of polymeric adsorbents include cross-linked polystyrene beads and polyacrylic resin beads marketed under the name Amberlite XAD®.

Suitable adsorbents include ion-exchange resins.

In addition to containing an adsorbent to remove organic compounds, the receiver sheet preferably contains a substance for solubilising silver halide and/or a substance capable of converting soluble silver into an insoluble form.

The silver, both developed and undeveloped, in the developed photographic material can be rendered soluble before contact with the receiver sheet by including in the developing solution, or another solution in a subsequent processing step, a means of solubilising the silver. Alternatively, a means of solubilising the silver may be incorporated in the receiver sheet. Examples of silver solubilising compounds include chelating agents and silver halide solvents. As silver solvents, thiosulphates, thiocyanates, thioether compounds, thioureas, thioglycoloic acid and sulphites can be used. A specific example is hydroxyethyletrahydrotriazole thione (HTTT). A preferred component is thiosulphate e.g. ammonium thiosulphate. Alternative counter ions such as alkali metal ions e.g. lithium, potassium, sodium, caesium and rubidium may be used.

The silver can be trapped in the receiver sheet by including substances which convert the silver in its soluble form into an insoluble form such as silver metal or an insoluble silver compound.

The receiver sheet may contain reducing means capable of forming metallic silver from solubilised silver halide. Examples of suitable reducing means include a metal more electropositive than silver dispersed in the receiver sheet e.g. particles of magnesium, zinc or aluminium. Alternatively, a salt such as zinc sulphide is used and the silver precipitated as silver sulphide. The receiver sheet may contain nuclei on which silver develops to give a metallic deposit.

Between the development step and lamination step, the method of the invention may include a development-stopping step, a bleach step, a fixing step or any combination of such steps. The receiver sheet may also contain a material to stop the development reaction when the lamination occurs.

As mentioned above, the developer solution may contain fixing agent and the receiver sheet may contain the means for converting the silver in its soluble form into an insoluble form such as silver metal or an insoluble silver compound.

Aqueous solution carried over from the development step or another step prior to lamination may be sufficient for the desired transfer of substances to the receiver sheet to occur. Preferably, the receiver sheet is soaked in an aqueous solution before lamination. In a preferred embodiment, the aqueous solution is acidic.

In another embodiment of the invention, removing unreacted developing agent from the material or inactivating unreacted developing agent in the material is achieved by applying to the surface of the developed material a solution of a sulphite compound that reacts with oxidised developing agent and prevents further development, and applying to the surface of the developed material a solution of an oxidant that oxidises any remaining developing agent, wherein said sulphite compound is present in an amount sufficient to react with all the oxidised developing agent.

Preferably, the sulphite compound is a hydrogen sulphite or metabisulphite compound. Examples of suitable compounds include soluble alkali metal, alkaline earth metal or ammonium hydrogen sulphites and metabisulphites e.g. sodium hydrogen sulphite and sodium metabisulfite.

The solution of the sulphite compound may contain the sulphite compound in an amount from 0.02 to 1 mole/1, preferably from 0.15 to 0.5 mole/1.

Preferably, the oxidant is a salt of a peroxy sulphuric acid such as peroxymonosulphuric acid ($H_2SO_5$) or peroxydisulphuric acid ($H_2S_2O_8$). Salts of peroxydisulphuric acid are often simply referred to as persulphates. Examples of suitable compounds include soluble alkali metal, alkaline earth metal or ammonium peroxymonosulphates and persulphates e.g. sodium peroxymonosulphate and sodium persulphate.

The solution of the oxidant may contain the oxidant in an amount from 0.02 to 1 mole/1, preferably from 0.15 to 0.5 mole/1. Preferably, the concentration of the oxidant is less than that of the sulphite compound.

It is preferred that the total amount of the solutions of sulphite and oxidant applied to the surface of the developed material does not exceed 100 ml/m$^2$. A preferred amount is from 20 to 60 ml/m$^2$.

The weight ratio of the solutions of sulphite and oxidant applied to the surface of the developed material may vary from 5:1 to 1:5. Preferably, the solutions are employed in substantially equal amounts.

The solutions of sulphite and oxidant are applied to the material by means other than immersion in a tank. Examples of suitable means include spraying from a fine nozzle, an air brush, an ink jet head or by application with a roller. The roller may or may not have a surface pattern, or a roller covered with an adsorbent material such as felt or sponge may be used. If two separate applications are required it is preferable that the second solution is applied by a non-contact method such as spraying with a nozzle, an air-brush or an ink-jet head.

In a preferred embodiment, the solutions of sulphite and oxidant are applied to the material sequentially. Preferably, the oxidant solution is applied within 20 seconds, more preferably within 10 seconds of application of the sulphite solution.

In an alternative embodiment, the solutions of sulphite and oxidant are applied to the material simultaneously. If the solutions are mixed together before application, it is preferable to apply the mixture within 10 seconds of mixing.

Only very low volumes of sulphite and oxidant solution need be used. Preferably, the volumes of solution used are such that there is substantially no effluent created. A small volume of solution can be accommodated by the swell of the photographic material being treated. Additional solution can be accommodated on the surface of the material without creating effluent. Subsequent drying of the material removes the unwanted water.

The invention provides a process which does not produce liquid effluent but produces high quality images of good image stability. In a number of forms of the invention as described, the process is very simple, and of low maintenance. It can combine these attributes with a low-silver material which is inexpensive to manufacture and which reduces the environmental impact of manufacturing and processing of the material.

The invention has the advantage not only of removing developer but also other materials which can be extracted using lamination or chemical treatment.

The invention may be employed in processing any silver halide photographic material.

The photographic elements can be single colour elements or multicolour elements having a paper or a transparent film base. Multicolour elements contain dye image forming units sensitive to each of the three primary regions of the spectrum. Each unit can be comprised of a single emulsion layer or of multiple emulsion layers sensitive to a given region of the spectrum. The layers of the element, including the various orders as known in the art. In an alternative format, the emulsions sensitive to each of the three primary regions of the spectrum can be disposed as a single segmented layer.

A typical multicolour photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers.

Suitable materials for use in this invention, can have any of the components described in Research Disclosure Item 36544, September 1994, published by Kenneth Mason Publications, Emsworth, Hants P010 7DQ, United Kingdom.

A description of typical photographic materials may be found in *Research Disclosure,* September 1997, p. 613, Section I.

Photographic processing steps such as development, bleaching and flxing together with the compositions used in those steps e.g. developing agents are described in, for example, *Research Disclosure,* September 1994, No.365, Sections XIX & XX and *Research Disclosure,* September 1997, p. 613, Section XXIII.

A preferred form of photographic processing is redox amplification also known as development amplification. Such processes are well known and details may be found in *Research Disclosure,* September 1997, p. 629-630, Section XVI.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, e.g. addition compounds of hydrogen peroxide or persulphates; cobalt (III) complexes including cobalt hexammine complexes; and periodates. Mixtures of such compounds can also be used.

In conventional processing (non-RX) of colour materials, separate bleach and fix baths or a bleach-fix bath which both bleaches silver image and removes all silver from the material may be employed. However, because of the small amounts of silver present in the photographic material used in RX processing, it is possible to leave out the processing stages that bleach and fix because the degradation of the image is minimal.

The invention is further illustrated by way of example as follows.

EXAMPLES

The experiments were all carried out with a low silver print material having a silver coverage of 84 mg/m$^2$, the silver being present as essentially all silver chloride. The material contained conventional colour couplers. The material was either exposed to room light for 5 second to give a Dmax density or not exposed at all to give a Dmin density. All processing took place at room temperature 22° C. in the dark.

The processing was carried out by applying processing solutions by means of ink-jet printers, the ink in the printer cartridges being replaced with the solutions described below. Each solution was applied with a separate ink-jet printer (Hewlett-Packard Desk-Jet 420) which had been modified in such a way that no part would touch the wetted surface of the paper being transported. Only a small area of paper was wetted with solutions, 5×5.5 cm. Each application of solution was substantially to the same area of the paper. The application of solution was controlled by the printer being driven by a PC, the appropriate image being printed from Adobe Photoshop. All solutions were applied at 20 ml/m$^2$ except for the developer that was applied at 4 ml/m$^2$ or 20 ml/m$^2$. The latter amount is that estimated to apply the amount of developer to give enough dye at Dmax+25% and the former, the estimated amount required in Dmin areas using the imagewise application of developer.

In the following compositions, Silwet L-7607 (Witco) is a commercially available wetting agent, Anti-Cal #5 is 1-hydroxy-ethylidene- 1,1-diphosphonic acid, Anti-Cal #8 is diethylenetriaminepentaacetic acid, pentasodium salt and CD3 is 4-N-ethyl-N-(β-methanesulphonamidoethyl)-o-toluidine sesqisulphate.

| Pre-Soak | |
|---|---|
| 2-pyrolidinone | 100 g |
| 25% sodium hydroxide | 70 g |
| Silwet L-7607 (Witco) | 10 g |
| Anti-Cal #5 | 4 g |
| Anti-Cal #8 | 10 g |
| Water | 690 g |
| 30% hydrogen peroxide added just before use | 100 g |
| Developer | |
| 2-pyrolidinone | 100 g |
| N,N'diethylhydroxylamine | 20 g |
| CD3 free base | 40 g |
| Silwet L-7607 | 10 g |
| 25% sodium hydroxide solution | 70 g |
| Water | 50 g |
| Remediation - part 1 | |
| A | |
| Sodium metabisulphate | 50 g |
| Silwet L-7607 | 10 g |
| Acetic acid, glacial | 27 g |
| Water | 913 g |
| B | |
| Sodium metabisulphate | 250 g |
| Silwet L-7607 | 10 g |
| Acetic acid, glacial | 100 g |

-continued

| | |
|---|---|
| Water | 913 g |
| Remediation - part 2 | |
| A | |
| Ammonium persulphate | 50 g |
| Silwet L-7607 | 10 g |
| Acetic acid, glacial | 83 g |
| Water | 857 g |
| B | |
| Ammonium persulphate | 150 g |
| Silwet L-7607 | 10 g |
| Acetic acid, glacial | 100 g |
| Water | 857 g |
| Residual developer test solution | |
| potassium hexacyanoferrate (III) | 25 g |
| sodium carbonate | 25 g |
| water to | 1 liter |

The process and timings were as follows:

| | |
|---|---|
| Pre-soak | as determined by printer + 30s |
| Develop | as determined by printer + 120s |

-continued

| | |
|---|---|
| Remediation - part 1 | as determined by printer + 60s |
| Remediation - part 2 | as determined by printer + 60s |

The processed material was then dried using a hair dryer.

There was no wash in the process and the process was repeated both versions of the remediation solutions.

To test for residual CD3 in the coating a 5 mm spot of the residual developer test solution was applied to the surface of the treated paper and left for one minute. This spot was washed off with 4 successive spots of water. If there was any residual developer this should have coupled with couplers in the paper to form a dye. A control was run where a fully treated Dmin area was washed in running water for 2 minutes to ensure any soluble dyes or unwanted chemistry such as developer was washed out. A yellow stain always existed in the control after the developer test, which may be due to oxidation of components in the paper layers or retained hexacyanoferrate (III) but all comparisons can be made to this control.

After processing, the densities of the treated patches and the test spots were read on a 'status A' densitometer.

The results obtained are as follows:

| | | Developer | | Patch density | | | After residual CD test | | |
|---|---|---|---|---|---|---|---|---|---|
| ID | Exp. | laydown | Version | R | G | B | R | G | B |
| Control | Dmin | 0.4 | A | 0.14 | 0.21 | 0.24 | 0.14 | 0.22 | 0.44 |
| 1 | Dmin | 0.4 | A | 0.15 | 0.22 | 0.24 | 0.15 | 0.22 | 0.42 |
| 2 | Dmin | 2.0 | A | 0.30 | 0.59 | 0.76 | 1.04 | 1.05 | 0.80 |
| 3 | Dmin | 0.4 | B | 0.20 | 0.23 | 0.26 | 0.20 | 0.23 | 0.25 |
| 4 | Dmin | 2.0 | B | 0.17 | 0.24 | 0.29 | 0.17 | 0.23 | 0.28 |
| 5 | Dmax | 0.4 | A | 0.73 | 0.84 | 0.91 | 0.72 | 0.85 | 1.12 |
| 6 | Dmax | 2.0 | A | 1.74 | 1.92 | 2.31 | 1.73 | 1.98 | 2.51 |
| 7 | Dmax | 2.0 | B | 1.72 | 1.94 | 2.31 | 1.74 | 1.96 | 2.50 |

It can be seen by inspection that remediation version A is sufficient to deal with the low laydown of developer in ID 1 which more or less matches the control washed sample. However, the low level of remediation chemistry is insufficient to destroy the high level of developer laydown in ID3. However, this low level of remediation (A) is sufficient to deal with the excess developer in the high developer laydown in the Dmax areas where the developer is consumed in making the image dye.

This suggests that if the residual level of developer is kept low over the whole image, a low level of remediation can be used. This can be achieved by the imagewise application of developer. If the high level of developer was applied over the whole image, the higher level of remediation chemistry would have to be applied to ensure destruction of the developer or alternatively the remediation could be applied at levels that reflected the expected amount of residual developer, i.e. to inverse of the image density.

The invention has been described in detail with particular reference to certain preferred embodiments thereof, but it will be understood that variations and modifications can be effected within the spirit and scope of the invention.

What is claimed is:

1. A method of producing a photographic image in an imagewise exposed photographic material comprising one or more silver halide emulsion layers which method comprises applying to the material in an imagewise manner a developer solution containing a silver halide developing agent wherein the amount of solution applied depends on the image density to be produced, removing unreacted developing agent from the material or inactivating unreacted developing agent in the material by means other than immersion of the material in a liquid in a tank.

2. A method as claimed in claim 1 wherein the step of removing unreacted developing agent from the material or inactivating unreacted developing agent in the material produces substantially no liquid effluent.

3. A method as claimed in claim 1 wherein the photographic material is a colour photographic material.

4. A method as claimed in claim 1 wherein development is accompanied by an amplification step.

5. A method as claimed in claim 1 wherein the removal of the unreacted developer is achieved by releasably laminating the material with a receiver sheet containing an adsorbent for the developing agent in oxidised and unoxidised form, and, after a period of time sufficient for adsorption of the developing agent in the receiver sheet, separating the photographic material and the receiver sheet.

6. A method as claimed in claim 5 wherein the adsorbent for the developing agent is carbon.

7. A method as claimed in claim 5 wherein the receiver sheet contains a compound capable of solubilising silver halide.

8. A method as claimed in claim 1 wherein removing unreacted developing agent from the material or inactivating unreacted developing agent in the material is achieved by applying to the surface of the developed material a solution of a sulphite compound that reacts with oxidised developing agent and prevents further development, and applying to the surface of the developed material a solution of an oxidant that oxidises any remaining developing agent, wherein said sulphite compound is present in an amount sufficient to react with all the oxidised developing agent.

9. A method as claimed in claim 1 further comprising the step of bleaching the material using a non-ferrous bleaching agent.

10. A method as claimed in claim 9 wherein the bleaching agent is a persulphate or peroxide.

11. A method as claimed in claim 4 which is carried out without a bleaching step.

12. A method as claimed in claim 4 comprising a fixing step between the development step and the step of removing or inactivating the developing agent.

13. A method as claimed in claim 4 wherein there is no processing step between the development step and the step of removing or inactivating the developing agent.

* * * * *